United States Patent [19]

Sairanen

[11] Patent Number: 4,719,390

[45] Date of Patent: Jan. 12, 1988

[54] ELECTRONIC MAINS CONNECTION DEVICE FOR A GAS DISCHARGE LAMP

[75] Inventor: Martti Sairanen, Vantaa, Finland

[73] Assignee: Helvar Oy, Helsinki, Finland

[21] Appl. No.: 667,201

[22] Filed: Nov. 1, 1984

Related U.S. Application Data

[63] Continuation-in-part of Ser. No. 381,417, May 24, 1982, abandoned.

[51] Int. Cl.[4] ..... H05B 41/16; H05B 41/24

[52] U.S. Cl. ..... 315/246; 315/DIG. 7; 315/DIG. 5; 315/290; 315/307; 315/224; 315/247

[58] Field of Search ..... 315/206, 208, 290, 307, 315/308, 224, 247, 243, 287, DIG. 5, DIG. 7

[56] References Cited

U.S. PATENT DOCUMENTS

| | | | |
|---|---|---|---|
| 3,525,900 | 8/1970 | Skirvin et al. | 315/98 |
| 3,969,652 | 7/1976 | Herzog | 315/287 X |
| 3,999,100 | 12/1976 | Dendy et al. | 315/208 X |
| 4,042,856 | 8/1977 | Steigerwald | 315/307 X |
| 4,060,752 | 11/1977 | Walker | 315/307 X |
| 4,170,747 | 10/1979 | Holmes | 315/307 |
| 4,240,009 | 12/1980 | Paul | 315/307 X |
| 4,251,752 | 2/1981 | Stolz | 315/206 |
| 4,277,728 | 7/1981 | Stevens | 315/307 |
| 4,400,651 | 8/1983 | Nelle | 315/208 X |
| 4,412,154 | 10/1983 | Klein | 315/307 X |

*Primary Examiner*—Saxfield Chatmon

*Attorney, Agent, or Firm*—Zarley, McKee, Thomte, Voorhees & Sease

[57] ABSTRACT

An inverter circuit electrically connecting a gas discharge lamp to a source of direct current voltage whereby the impedance of said lamp is resistive. Current measuring means for measuring the lamp high frequency current flow and in electrical communication with control means for controlling the on/off ratio of said inverter for maximum lamp current.

9 Claims, 9 Drawing Figures

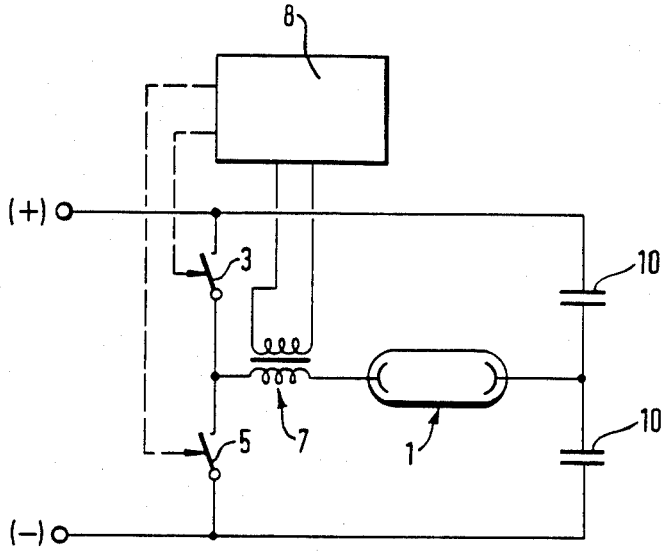
Fig. 3
Fig. 4
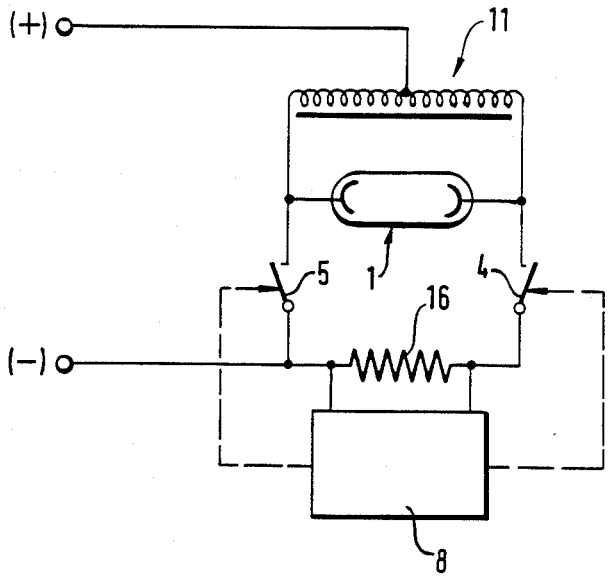

ELECTRONIC MAINS CONNECTION DEVICE FOR A GAS DISCHARGE LAMP

This is a continuation in part of application Ser. No. 381,417, filed May 24, 1982, now abandoned.

Electronic mains connection device for a gas discharge lamp.

The present invention relates to an electronic mains connection device for a gas-discharge lamp, acting as a stabilizing current limiting element and comprising an inverter circuit which from rectified mains current or some other direct current converts the service current for a lamp to such a high frequency that the impedance of a discharge lamp is like normal resistance.

Thus, the invention relates to an inverter circuit embodied by means of semi-conductors and applied in a mains connection device of gas-discharge lamps for feeding current to the lamp.

In this context, the term gas-discharge lamps refer to lamps generally used for lighting and whose internal impedance in normal alternating current service of 50 or 60 Hz is characteristically negative resistance and which thus require a gas-discharge stabilizing current limiting element. Such lamps primarily comprise fluorescence lamps, low-pressure and high-pressure sodium lamps, mercury vapour lamps and halogen lamps.

Prior known are a plurality or various electronic circuit solutions effected by means of semi-conductors and passive components suitable as the connection means for a gas-discharge lamp. These solutions are based on converting direct current one way or another to alternating current having substantially 50 Hz higher frequency. At this higher frequency a lamp is fed with an electric energy required by its gas-discharge. The advantages gained include improved light efficiency due to increased service frequency, reduction of the mechanical size of necessary electromagnetic components and thereby reduction of the connection device's own power loss as well as reduction of the weight of a connection device. An obvious advantage is also that it is generally easy to combine the control of a lamp's illumination level with an electronically effected connection device solution. In most circuit solutions for an electronic connection device, it is easy to develop sufficient voltage for the ignition of a discharge lamp without a separate igniter. Furthermore, an electronic connection device does not produce sound disturbances providing that service frequency is selected from above the hearing range. It is possible to eliminate a disturbing flicker from the light emitted by the lamp. An electronic connection device can also be effected, so that the curve of a current taken up by the apparatus from the alternating mains is nearly sine-shaped and its power factor is cos 1, whereby separate components for the compensation of the mains current are not required.

The prior art embodiments of an electronic connection device generally include some lamp current limiting impedance; a choke, a capacitor, a resistor or a combination thereof connected in series with a lamp and a source of supply voltage (e.g., DOS Publication No. 2 550 550).

Physically known is that the impedance of a discharge lamp turns from negative resistance to what is like normal resistance with the lamp operated at an alternating voltage whose frequency is within the range of 1 kHz . . . 150 kHz. Partially based on this phenomenon, it is known to employ a so-called blocking-oscillator circuit in one form or another (e.g., U.S. Pat. Nos. 3,629,648, 3,906,302 and 4,168,453). In such a circuit, a lamp is directly coupled to the supply voltage at the half-cycle a switch element (e.g., a transistor) is conducting by, and the voltage at the terminals of a lamp turns opposite on the part of a cycle on which the switch element is in non-conductive state. This inverted voltage is developed from the magnetizing energy charged in an inductance which is parallel-coupled with the lamp, said magnetizing energy discharging through the lamp as the switch element is opened.

The present invention is also based on a circuit solution capable of operating discharge lamps at the above-mentioned relatively high frequencies on which a discharge lamp behaves as normal resistance. However, a circuit solution according to the invention differs from the prior art solutions in that it does not require any inductive or capacitive member for the stabilization of a lamp's gas-discharge.

It has been found experimentally that a discharge lamp can be operated by connecting it by means of inverter switches directly to a source of supply voltage by reversing the polarity of a lamp on each half-cycle. The switching frequency must then be so high that a discharge lamp behaves as a resistance.

However, the above-described mode of operation is not stable but there is a tendency in the lamp towards "a breakaway phenomenon" which is substantially slower than the length of a cycle of service frequency and, as a consequence of which, the current tends to increase with the voltage remaining constant. To overcome this phenomenon according to the invention, such a current breakaway phenomenon is prevented by measuring the rate of a current running through the lamp and by employing feed-back control for maintaining this current rate at a desired value. In the feed-back it is possible to employ the filtering time constant of a measuring quantity, which e.g. at a service frequency of 40 kHz can be circa 0,2 ms.

The characterizing features of the present invention are set forth in the accompanying claims.

The following advantages are gained by the solution of the invention:

1. No need for winding components or capacitors dimensioned for the main current.

2. No need for capacitors whose operating temperature has a fixed range, the connection device being applicable for use at a higher operating temperature as disposed e.g. directly in connection with a lamp.

3. The connection device is low in costs since the above-mentioned expensive components are left out.

4. The above components are also the most bulky in the prior art connection devices and thus the present connection device can be made more compact without said components and be used in smaller spaces.

5. The main curent of the connection device can be entirely effected by means of semi-conductors.

In the following some embodiments of the invention are described in more detail with reference made to the accompanying drawings, in which FIG. 1 illustrates the principle diagram of a mains connection device of the invention.

FIGS. 3 and 4 show subsequent modifications of the invention the same way as FIG. 1.

Figure 1:
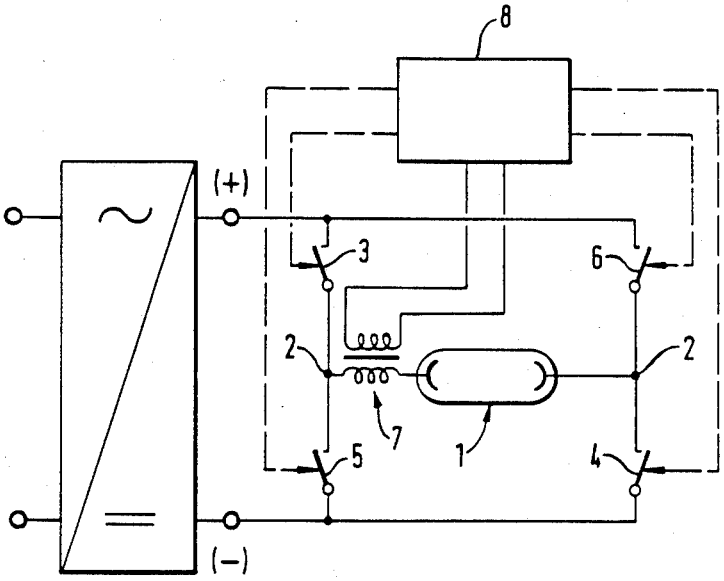
Figure 2:
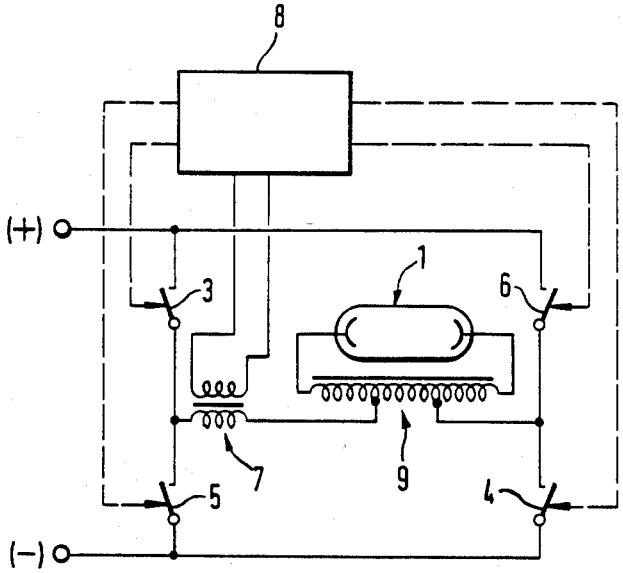
FIG. 2 shows another embodiment of the invention as a principle diagram.
Figure 7:
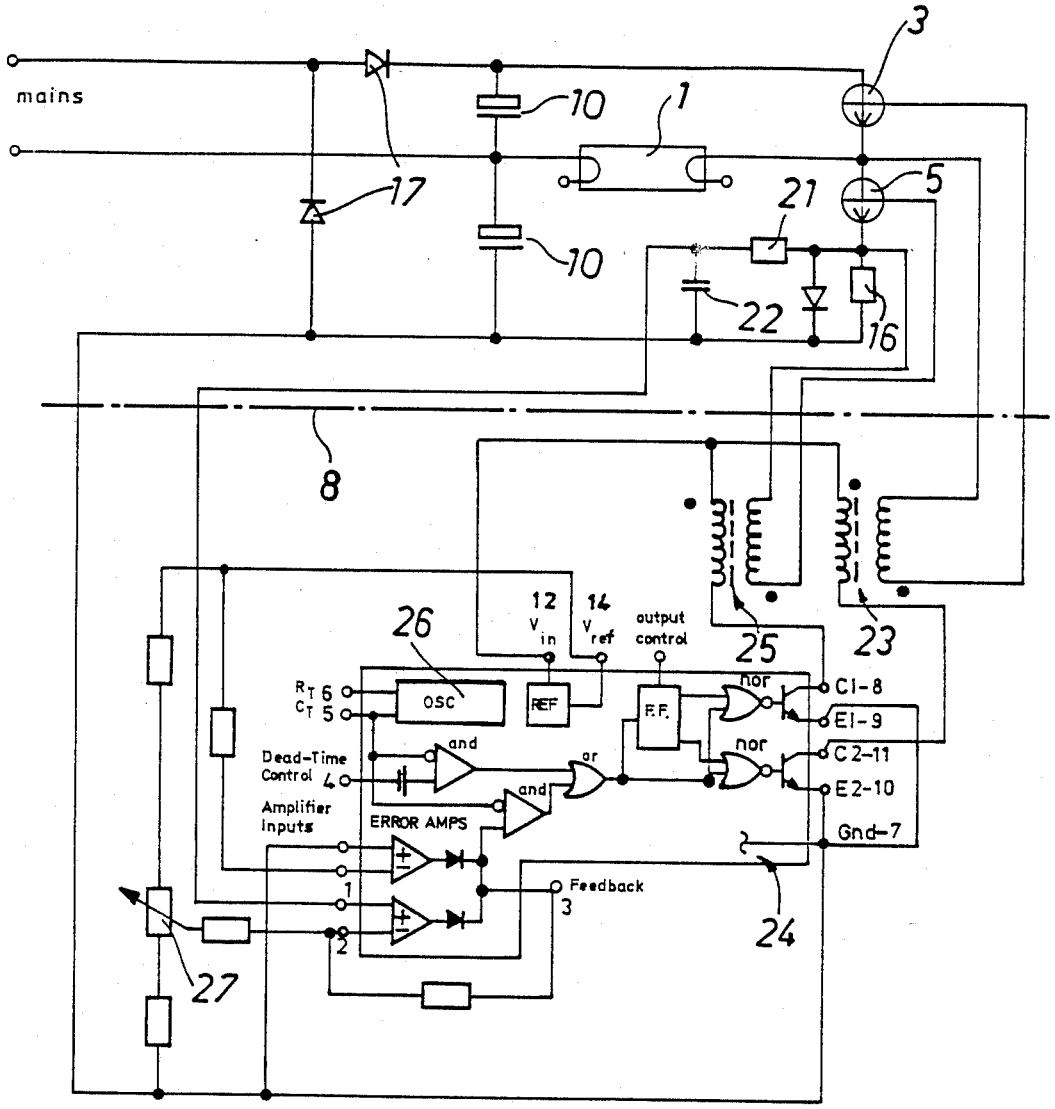
FIG. 7 is similar to FIG. 6 and showing further detail of pulse width modulator 24.

Referring to FIG. 1, a gas-discharge lamp 1 is connected to a source of direct current by way of four electronic switches 3–6 in a manner that these switches make up an inverter circuit by means of which the polarity of supply voltage at the terminals of lamp 1 is reversed at a high frequency which is within the range of circa 1 kHz . . . 150 kHz. This reversal of polarity is effected in a manner that, with switches 3 and 4 closed, switches 5 and 6 are open and when the latter switches are closed, the former switches are opened. In addition, between closing and opening of the switches there can be an interval of adjustable length when all switches are open. This can be used for the regulation of the lamp's illumination level. As pointed out above, the circuit solution of a connection device of the invention is not provided with any current limiting impedance element, but instead, the current is only limited by means of the lamp's 1 own resistance-like impedance at said high inverting frequency. However, this would not be possible without an additional arrangement of the invention since the current of lamp 1 would tend to break away on an interval substantially longer than the inverting cycle. In order to eliminate this breakaway phenomenon, the invention provides a feedback control, wherein a current transformer 7 or some other current measuring means, such as a resistor, is used to sense the current of lamp 1 and, on the basis of this current rate, a control unit 8, such as the TL 494 C pulse-width modulation control circuit of Texas Instruments shown in more detail in FIG. 7, controls the open times and/or operating frequency of the inverter circuit switches 3–6 in a manner that the current of lamp 1 remains constant. Such control units are well known and may include, for example, an oscillator for giving base control pulses to switches 3 and 5 whereby the pulse shape (on/off ratio) of the oscillator is controlled by the voltage from the lamp current sensor. The circuit illustrated in FIG. 2 is otherwise similar to that of FIG. 1 except that a lamp 1 is connected to an inverter circuit and to a source of direct current by means of an economy transformer or autotransformer 9 which increases the supply voltage of lamp 1 with respect to the voltage of a current source. An economy transfer 9 can be further used for glowing the cathodes of lamp 1 to improve the ignitability of the lamp. In addition, an economy transformer 9 can serve to create an ignition voltage peak sufficient for the ignition of lamp 1.

The embodiment of FIG. 3 differs from that of FIG. 1 in that switches 6 and 4 are replaced by capacitors 10 in order to simplify the circuit. This is a suitable approach in the applications in which the temperature limitation set by the capacitors is of no significance.

In the embodiment of FIG. 4, switches 3 and 6 of the circuit solution shown in FIG. 1 are replaced by an economy transformer 11, one of the terminals of a current source being connected to its central outlet. The magnetizing inductance of an economy transformer 11 can be conventionally employed for creating an ignition voltage peak for lamp 1. A resistor 16 is used for measuring a current passing through the lamp in the other direction which measuring method, as for the operation of the device, replaces the measuring effected in other embodiments by means of a current transformer.

Figure 5:
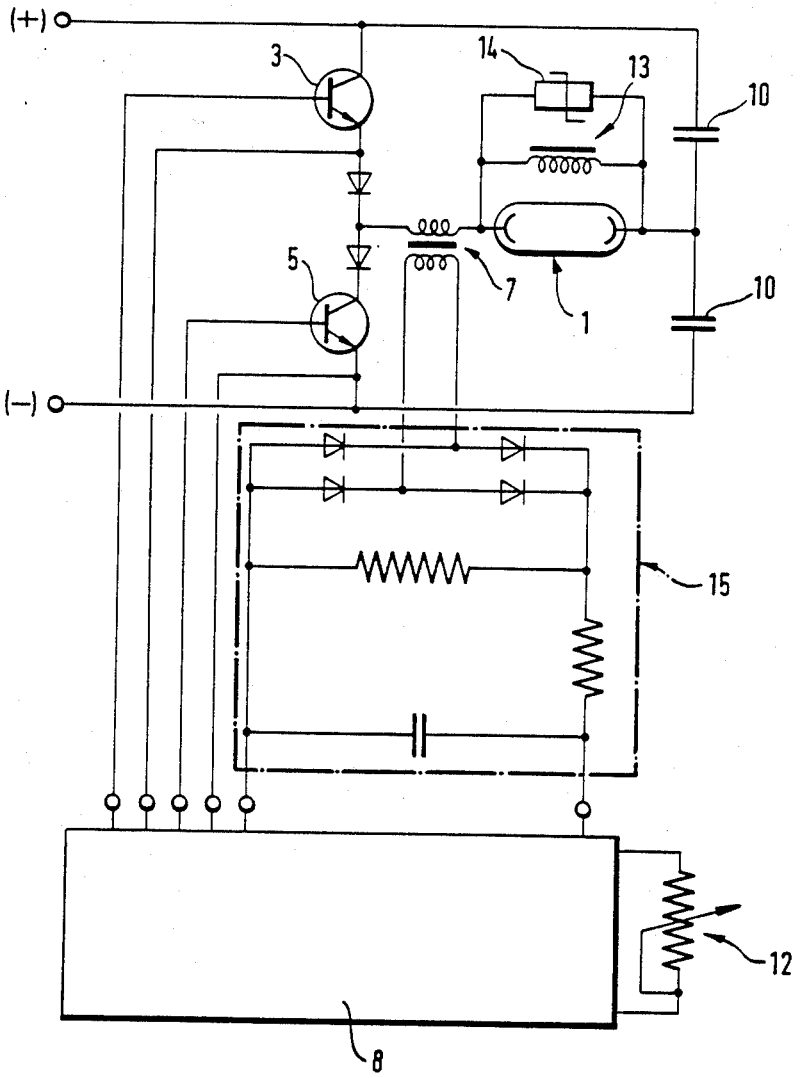
FIG. 5 shows a circuit diagram for a mains connection device according to one embodiment for the invention with only those components shown which are most essential for the operation of the device.

FIG. 5 illustrates a further developed embodiment corresponding to FIG. 3, comprising parallel to a lamp 1 an ignition voltage peak creating inductance 13 and parallel to that an overvoltage protector 14. A current transformer 7 senses a current passing through lamp 1, said current rate being passed through a rectifying circuit 15 to a control unit 8. On the basis of this current rate, a control unit 8 issues control pulses for the control electrodes of transistors serving as switches 3 and 5, the duration and/or operating frequency of said control pulses changing as necessary for maintaining the current passing through lamp 1 constant. In order to set this current to be maintained constant at various values for the regulation of illumination emitted by lamp 1, said control unit 8 is provided with a regulator 12 capable of having effect on the opening times of switch transistors 3 and 5 or on their inverting frequency.

Figure 6:
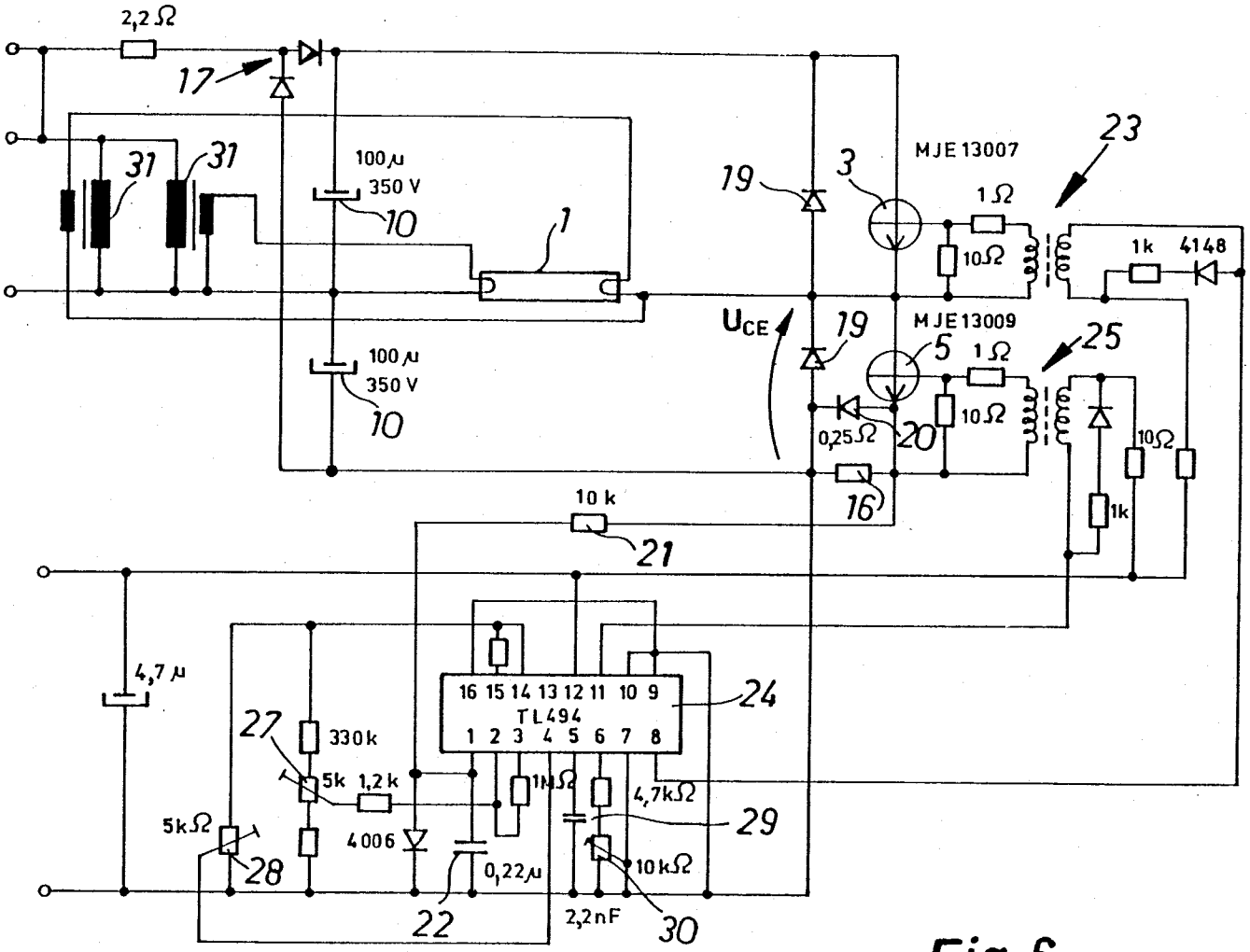
FIG. 6 shows a detailed diagram of another embodiment of the invention, utilizing features of the circuits shown in FIGS. 4 and 5.

In FIG. 6, transformers 31 supply the filament current for the lamp 1. Mains supply of 220 VAC is rectified by diodes 17. Diodes 19 protect the transistors from transient voltage peaks which are induced by the inductance of the conductor between the transistors and the lamp and which appear when the current is suddenly switched off. Each power supply capacitor 10 is loaded to 310 VDC which is supplied by transistor switches 3 and 5 to the lamp 1. The transistor switches 3 and 5 are controlled by their base control transformers 23 and 25, depending on the voltage across the primary of base control transformer 23 or 25, the corresponding transistor 3 or 5 is conductive or non-conductive. Thus, by controlling the secondary voltage, the transistors can be turned on or off. When the control voltage is pulse shaped, the transistors are turned on and off by the pulse frequency of the control voltage.

In the circuit shown in FIG. 6, there is no inductor and no resonance circuit. The operating frequency is determined by an oscillator 26 (FIG. 7) which is included in a pulse-width-modulation control circuit 24, such as the TL 494 C by Texas Instruments. Resistor 27 is the same as resistor 12 in FIG. 5. Resistor 27 is used to control the on/off ratio of the control voltage, thereby controlling the on/off ratio of the switches 3 and 5 for controlling the lamp current and the level of illumination. The oscillation frequency can be determined by timing resistor 30 and timing capacitor 29. The output transistors of circuit 24 give pulses by said frequency, whereby the width of the output pulses can be controlled by controlling the voltage across the terminals 1 and 2 of the error amplifier in circuit 24.

The voltage across resistor 16 depends upon the lamp current. When the lamp current increases, the increasing voltage drop across the resistor 16 controls the circuit 24 so as to decrease the pulse width of the output pulses, which control the base drive transformers 23 and 25. The on/off ratio of transistors 3 and 5 decreases and the lamp current decreases. Resistor 28 can be used to set the maximum value for the on/off ratio of the control pulses, which also sets the maximum lamp current.

Diode 20 in parallel with measuring resistor 16 shows that even the resistance 16 can be shunted to avoid any current limiting impedances of the lamp circuit. The voltage drop across the measuring resistor 16 is smaller than the forward biasing voltage drop of diode 20. Resistor 21 and capacitor 22 operate so as to filter the pulse-shaped current into a direct voltage.

Figure 8:
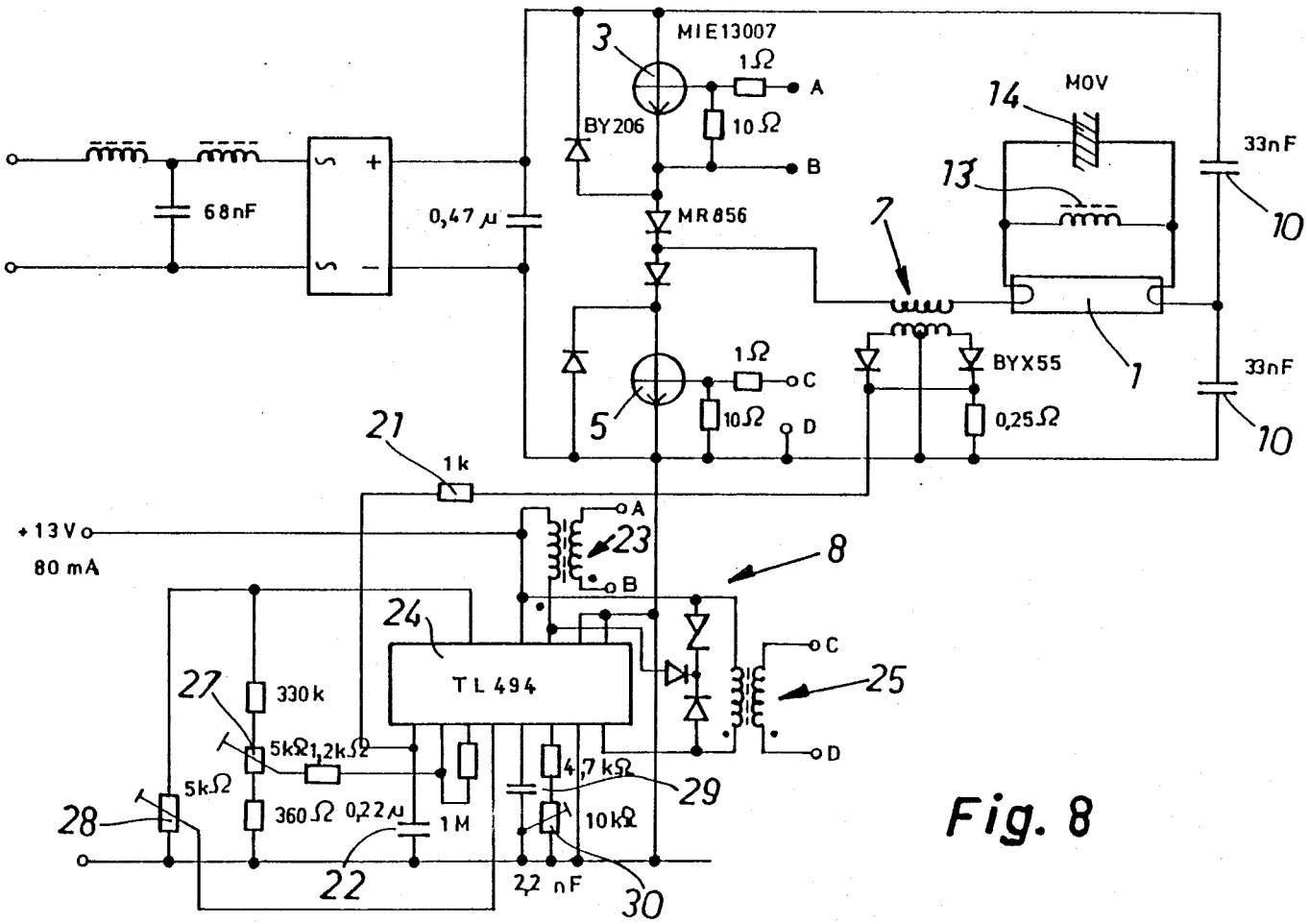
FIG. 8 shows the circuit of FIG. 5 in more detail.
Figure 9:
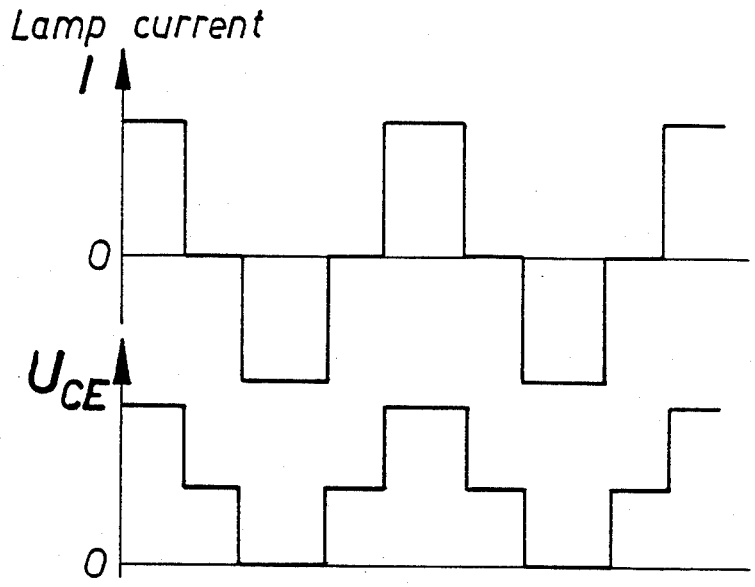
FIG. 9 is a graph showing the current through the lamp and the collector-emitter voltage Uce of transistor 5 of FIG. 6.

FIG. 8 shows a modified circuit wherein there is no filament heating current transformer 31 and the mains voltage peak value is used as AC supply voltage (not doubled as in FIG. 6). Instead of resistor 16, the lamp current is measured by a current transformer 7. The diodes in series and in parallel with the transistors 3 and 5 protect the transistors from the voltage peaks generated by the ignition inductor 13 in parallel with the lamp.

The inductors and the capacitor between the mains terminals and the rectifier filter the radio frequencies generated by the device, i.e., the filter protects the mains net from radio frequences of the device. Therefore, these inductors are very small and can be included in integrated circuits. The filament heating transformers 31 or ignition inductor 13 are the only larger, and therefore separate components of the circuit. The zener in the secondary of transformers 23 and 25 serves for further protection.

One important objective of the present invention is the avoidance of power components which cannot be integrated with other components. The present invention is the first to propose that lamp current is limited without current limiting impedance in series with the lamp having negative resistance.

What is claimed is:

1. An electronic mains connection device for a gas-discharge lamp electrically connected to a direct current source, said device comprising:

an inverter circuit electrically connecting said lamp to said direct current source for converting the service current of said lamp to a high frequency alternating current whereby the impedence of said lamp is resistive, said inverter circuit including a plurality of switches;

current measuring means in electrical communication with said lamp for sensing the high frequency alternating current of said lamp;

control means in electrical communication with said current measuring means for controlling the on/off ratio of said switches in said inverter circuit in response to the measurement of lamp current whereby the current of said lamp remains constant, said control means including a means for setting the maximum value of the on/off ratio, which also sets the maximum lamp current;

the current of said lamp being significantly limited only by the resistance-like impedance of said lamp present therein at said high inverting frequency, the other impedances of the circuit being considerably smaller than the lamp impedance so that the total impedance of the circuit is not capable of limiting the lamp current during several half cycles of the high frequency alternating current.

2. The device of claim 1 wherein an autotransformer electrically connects said lamp to said inverter circuit and to said direct current source such that the voltage in said lamp is higher than the voltage of said direct current source.

3. The device of claim 1 wherein said inverter circuit includes a plurality of switches and capacitors.

4. The device of claim 1 wherein said inverter circuit includes a plurality of switches and an autotransformer.

5. The device of claim 1 wherein an ignition element is in parallel electrical communication with said lamp for igniting said lamp.

6. The device of claim 1 wherein said inverter circuit includes transistors, said control means regulating the voltage of said transistors.

7. The device of claim 6 wherein said control means includes a regulating means for regulating the illumination emitted by said lamp.

8. A method for stabilizing the current of a gas-discharging lamp electrically connected to a direct current source, comprising:

converting the service current of said lamp to a high frequency alternating current whereby the impedance of said lamp is resistive;

significantly limiting the current of said lamp only by the resistance-like impedance of said lamp which is considerably greater than the other impedances of the circuit such that the total impedance of the circuit is incapable of limiting the lamp current during several half cycles of the high frequency alternating current;

measuring the high frequency alternating current of said lamp; and controlling the on/off ratio of said converted service current in response to the measured current of said lamp, such that the current of said lamp remains constant, and setting the maximum value of the on/off ratio, which also sets the maximum lamp current.

9. The device of claim 1 wherein said current measuring means is a current transformer electrically connected in series with said lamp.

* * * * *